US007270043B2

(12) United States Patent
Presz, Jr. et al.

(10) Patent No.: US 7,270,043 B2
(45) Date of Patent: Sep. 18, 2007

(54) POWERED LOWER BOBBIN FEED SYSTEM FOR DEFLECTOR TYPE ROTARY BRAIDING MACHINES

(75) Inventors: Walter M. Presz, Jr., Wilbraham, MA (US); Stanley Kowalski, III, Wilbraham, MA (US)

(73) Assignee: Wardwell Braiding Machine Company, Central Falls, RI (US)

( * ) Notice: Subject to any disclaimer, the term of this patent is extended or adjusted under 35 U.S.C. 154(b) by 0 days.

(21) Appl. No.: 11/339,723

(22) Filed: Jan. 25, 2006

(65) Prior Publication Data

US 2006/0225564 A1 Oct. 12, 2006

Related U.S. Application Data

(60) Provisional application No. 60/647,187, filed on Jan. 25, 2005.

(51) Int. Cl.
*D04C 3/42* (2006.01)

(52) U.S. Cl. ..... 87/48

(58) Field of Classification Search ..... 87/48
See application file for complete search history.

(56) References Cited

U.S. PATENT DOCUMENTS 4,616,553 A * 10/1986 Nixon ..... 87/48
5,099,744 A * 3/1992 Hurst et al. ..... 87/45
5,913,959 A * 6/1999 Klein et al. ..... 87/44
5,974,938 A * 11/1999 Lloyd ..... 87/56
6,370,999 B1 * 4/2002 Lache et al. ..... 87/48

* cited by examiner

*Primary Examiner*—Shaun R. Hurley
(74) *Attorney, Agent, or Firm*—Holland & Bonzagni, P.C.; Donald S. Holland, Esq.

(57) ABSTRACT

A Powered Lower Bobbin Feed ("PLBF") system is disclosed for improving the operation of deflector type rotary braiding machines, such as the Wardwell Rapid Braider. The PLBF eliminates or reduces the impulsive tension spikes set up by the deflection and feed process in current rotary braiding machines by uniquely controlling the lower bobbin filament feed. These tension spikes result from: the rapid rotational acceleration and deceleration required of the lower bobbin as a result of the feed process; the lever arm tension control and bobbin ratchet mechanism; and the shape of the filament deflector surface. Such failure limits the operating speed of rotary braiding machines, the minimum size of filament that can be braided effectively, or the ability to maintain the quality of the braid produced. By eliminating or reducing these spikes, the PLBF therefore can increase the working speed of circular braiding machines and improve the uniformity of braided filaments generated by such machines at a given speed. In the preferred embodiment, the PLBF comprises: a slip ring designed to provide power to the lower bobbins; a variable speed powered lower bobbin concept; a feedback control system for the bobbins to assure bobbin feed matches braid consumption; and an improved, more contoured, deflector surface to minimize feed tension spikes. The new contour can be created: by retrofitting existing deflectors with a spline; or, by making new deflectors that incorporate the overall contour of a retrofitted deflector.

10 Claims, 7 Drawing Sheets

POWERED LOWER BOBBIN FEED SYSTEM FOR DEFLECTOR TYPE ROTARY BRAIDING MACHINES

RELATED APPLICATION

This application claims priority from U.S. Provisional Patent Application Ser. No. 60/647,187, filed Jan. 25, 2005.

BACKGROUND OF THE INVENTION

Braiding machines have long been known in the art for braiding-multiple filaments of materials, e.g., synthetics, plastics or metals, such as copper or stainless steel wire, at reasonably high production rates. One type of braiding machine, which is commonly referred to as an internal cam rotary braider, has been known to the art for many years. One of the best-known rotary (a.k.a. "circular") braiders is the Wardwell Rapid Braider (hereinafter the "Rapid Braider" or "Wardwell rotary braiding machine"), made and sold by Wardwell Braiding Machine Company of Central Falls, R.I., U.S.A. (hereinafter "Wardwell"). Wardwell is the Assignee of the current application.

Wardwell rotary braiding machines have been available in various sizes, depending on the number of filaments required in the final braided output, and have been in use for many decades since the first designs were introduced about the turn of the century. Their reliability and relatively high speed of operation have been well recognized. Such machines have been used satisfactorily over the years, normally requiring only the replacement of parts. Hence, their structure and operation have essentially remained unchanged since their original design.

Simon W. Wardwell co-invented the Rapid Braider machine at the Wardwell Braiding Machine Company. U.S. Pat. No. 1,423,587 entitled "YARN RETRIEVER FOR BRAIDING OR OTHER MACHINES" issued on Jul. 25, 1922. It disclosed and claimed the Rapid Braider.

An improved rotary braider, called the "Speed Master" (not shown), was later invented at the Wardwell Braiding Machine Company. The Speed Master changed the angle of the braid feed.

Both the Rapid Braider and the Speed Master machines represent a broader class of rotary braiding machines for braiding filaments of fiber, thread or other spoolable medium about a common central axis. They are also known as deflector type rotary braiding machines.

As shown in FIGS. 1-3 of U.S. Pat. No. 1,423,587 (reproduced in the current application as FIGS. 1, 7 and 2 respectively), the Rapid Braider machine comprises: a radially more inward tray of bobbins, i.e., an upper array of bobbins; and a radially more outward array of similar bobbins, i.e., a lower array of bobbins). The upper and lower arrays of bobbins rotate in opposite directions about a common center axis. As each array rotates, its bobbins supply filament to, and wind the filament around, a mandrel at the axis. Filament deflectors and guides associated with each lower bobbin direct the filament therefrom alternately below and above the upper bobbins as the bobbin arrays rotate. This process produces the braid. The alternating deflection of the lower bobbin filament above and below the upper bobbins can be set up to occur with any number of upper bobbins to obtain the desired braid pattern.

FIG. 3 of U.S. Pat. No. 1,423,587 shows sample deflector guides. These guides have both an upper and lower contour for deflecting the filament. If the filament impacts on the top surface, it gets deflected over the upper bobbin. If the filament impacts the lower surface; it remains below the upper bobbin. In this fashion, the weave of the braid is formed as the bobbin arrays rotate in opposite directions. That same drawing figure also presents the lower bobbin tension control arm which is used to take up filament slack and minimize tension as the filament is being deflected. This lever acts as an idler arm and a tension control device. This same lever arm, when deflected over a large angle, releases a ratchet mechanism on the lower bobbin which allows the bobbin to turn and feed filament. Typically this release occurs near the height of the filament deflection process.

New engineering analyses and tests (by the current Applicants) of failure mechanisms on both the Rapid Braider and Speed Master machines have shown that most failures, or filament breakage during braiding, are a result of tension spikes in the filament set up by impulsive forces generated during the spool feed process on the machines' lower bobbins. These tension spikes result from: the rapid rotational acceleration and deceleration required of the lower bobbin as a result of the feed process, the lever arm tension control device, the actuation of the bobbin ratchet mechanism and the shape of the filament deflector surface required for the braiding operation. Such failure limits the operating speed of rotary braiding machines, and/or the minimum size of filament that can be braided effectively, and/or the ability to maintain the quality of the braid.

Accordingly, it is a general object of the present invention to provide a new powered bobbin feed which improves the braiding process of deflector type rotary braiding machines, such as the Rapid Braider or Speed Master.

It is another general object to provide a new Powered Lower Bobbin Feed for deflector type rotary braiding machines, which reduces the unwanted stresses placed on a filament of material being handled thereby, reducing breakage in the braiding process.

It is yet another general object to provide a new Powered Lower Bobbin Feed for deflector type rotary braiding machines, which can increase the working speed of rotary braiding machines.

It is yet another general object to provide a new Powered Lower Bobbin Feed for deflector type rotary braiding machines, which can improve the uniformity of braided filaments generated by such machines at a given speed.

It is a more specific object, commensurate with the above listed objects, to eliminate tension spikes on a filament of material being handled by a rotary braiding machine by replacing the conventionally used lower carrier members of such machines with a new Powered Lower Bobbin Feed.

BRIEF DESCRIPTION OF DRAWINGS

The above and other objects will become more readily apparent when the following description is read in conjunction with the accompanying drawings, in which.

SUMMARY OF THE INVENTION

Applicants have improved the prior Wardwell braiding machines by replacing the conventionally used lower carrier members of those machines with a new Powered Lower Bobbin Feed ("PLBF") system. The PLBF reduces the unwanted stresses placed on a filament of material being handled thereby, reducing breakage in the braiding process. The Powered Lower Bobbin Feed improves the operation of not only the Wardwell rotary braiding machines but also all other deflector type, circular braiding machines.

The PLBF concept eliminates or reduces the impulsive tension spikes set up by the deflection and feed process in current rotary braiding machines by uniquely controlling the lower bobbin filament feed. These tension spikes result from: the rapid rotational acceleration and deceleration required of the lower bobbin as a result of the feed process; the lever arm tension control and bobbin ratchet mechanism; and the shape of the filament deflector surface. Such failure limits the operating speed of rotary braiding machines, the minimum size of filament that can be braided effectively and/or the ability to maintain the quality of the braid produced. The PLBF concept can increase the working speed of circular braiding machines, or improve the uniformity of braided filaments generated by such machines at a given speed.

In this application, Applicants have disclosed multiple embodiments of their PLBF concept. Their preferred embodiment comprises: a slip ring designed to provide power to the lower bobbins; a variable speed powered lower bobbin concept; a feedback control system for the bobbins to assure bobbin feed matches braid consumption; and an improved, more contoured, deflector surface to minimize feed tension spikes during operation of the braiding machine. The new contour can be created: by retrofitting existing deflectors with a spline; or, by making new deflectors that incorporate the overall contour of a retrofitted deflector.

DESCRIPTION OF PREFERRED EMBODIMENTS

Figure 1:
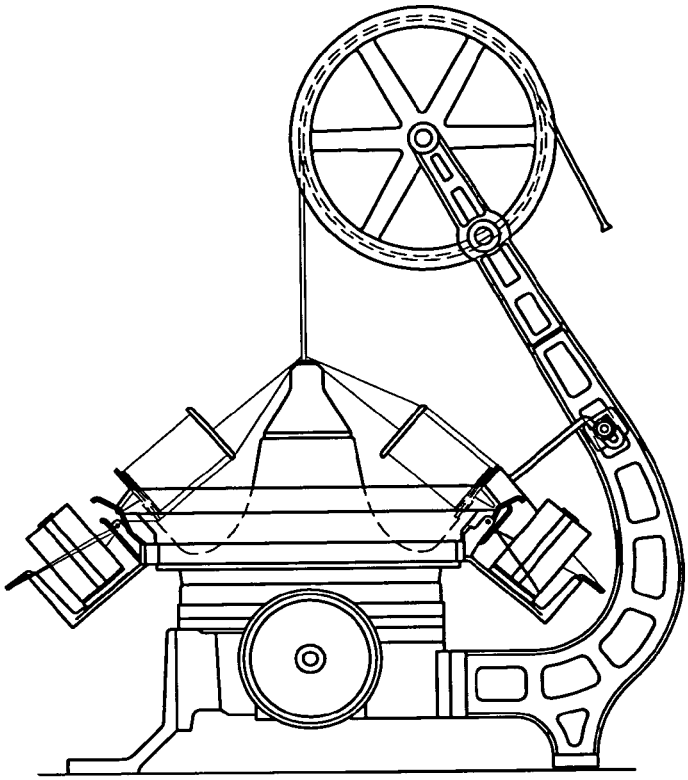
FIG. 1 (PRIOR ART)
FIG. 1, labeled "Prior Art", is a reproduction of FIG. 1 in U.S. Pat. No. 1,423,587; it is an elevational plan view of the aforementioned Rapid Braider rotary machine.
Figure 2:
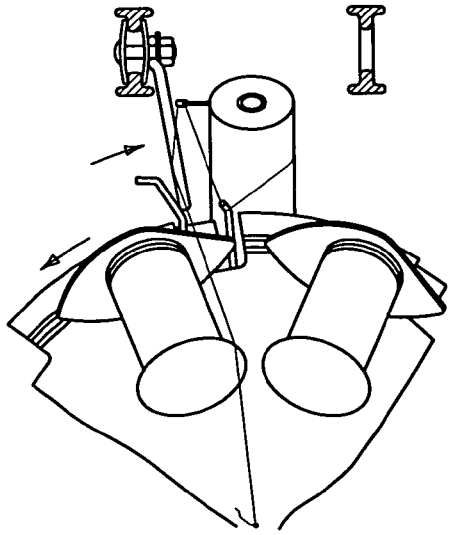
FIG. 2 (PRIOR ART)
FIG. 2, labeled "Prior Art", is a reproduction of FIG. 3 in U.S. Pat. No. 1,423,587; it shows the deflector and tension control mechanisms of the Rapid Braider.

Applicants hereby incorporate by reference U.S. Pat. No. 1,423,587 entitled "YARN RETRIEVER FOR BRAIDING OR OTHER MACHINES" issued on Jul. 25, 1922. That patent, described in the Background section of the current application, was for the current Assignee's "Rapid Braider" rotary braiding machine. Current FIGS. 1, 7 and 2, including their unchanged reference numbers, are reproduced respectively from FIGS. 1-3 in U.S. Pat. No. 1,423,587. Legends however have been added for clarification.

Figure 3:
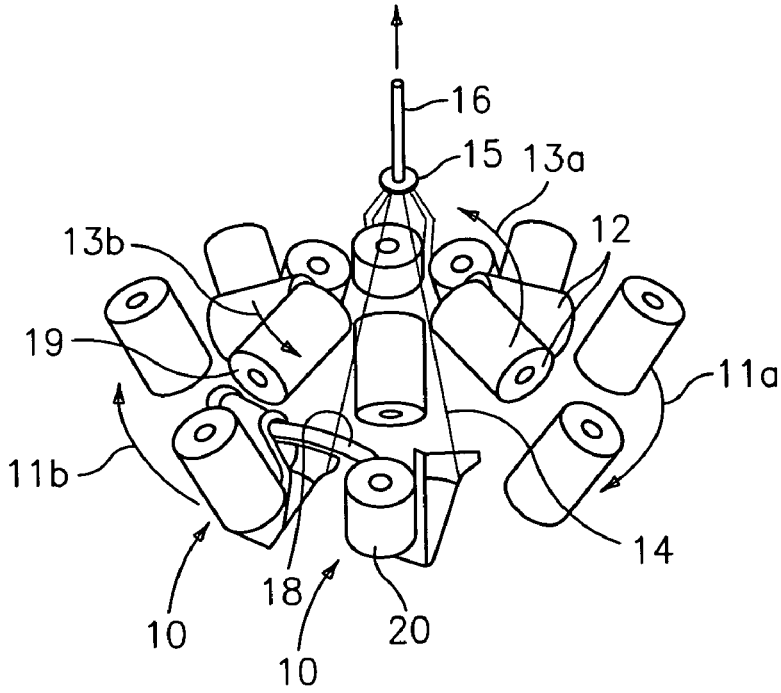
FIG. 3 (PRIOR ART)
FIG. 3, labeled "Prior Art", depicts diagrammatically the operation of an existing Wardwell rotary braiding machine, like the Rapid Braider and Speed Master.

The structure and operation of a typical Wardwell rotary braiding machine (e.g., the aforementioned Rapid Braider) is well known in the industry. It is also described in the instruction manuals available with such machines. One such manual, designated as "Wardwell Instruction Manual, Rapid Braiders," has been provided as part of the Information Disclosure Statement associated with this application. FIG. 3 is an illustration adapted from a typical manual, and depicts diagrammatically the operation of a typical well-known Wardwell machine as described therein and as would be well known to those in the braiding industry.

Figure 4:
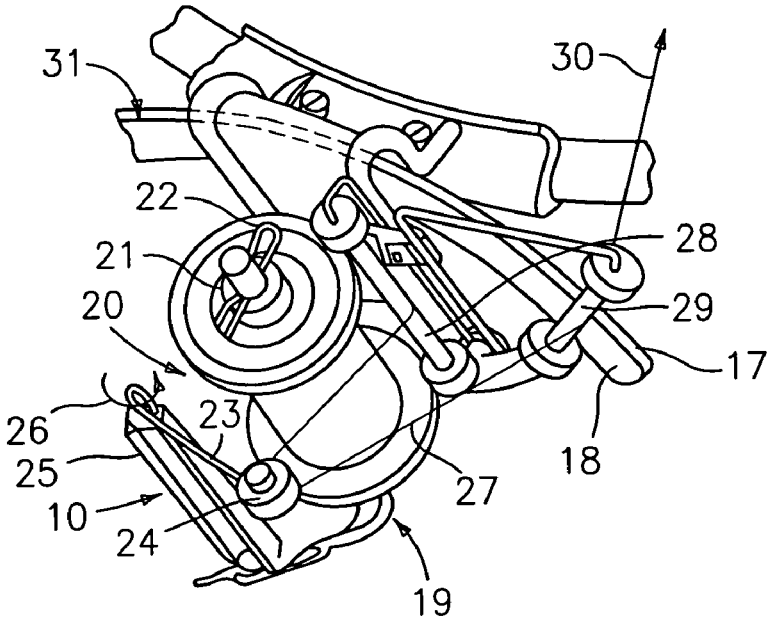
FIG. 4 (PRIOR ART)
FIG. 4, labeled "Prior Art", shows a perspective view of a lower carrier member used in an existing Wardwell machine, like the Rapid Braider and Speed Master.

As can be seen in Applicants' FIG. 3 and in more structural detail in Applicants' FIG. 4, a plurality of lower carrier members 10 move in the direction of arrows 11*a*, 11*b*, while a plurality of upper carrier members 12 move past lower carrier members 10 in the opposite direction (see, e.g., directional arrows 13*a*, 13*b*). A filament 14 of material is supplied from a bobbin 20 on each lower carrier for intertwining with filaments (not shown) supplied from a bobbin 19 on each upper carrier member. A filament from the lower carrier, for example, passes over one upper carrier member, then under the next adjacent upper carrier member, then over the next adjacent upper carrier member, and so on, as the upper and lower carriers move past each other in opposite directions. The intertwined filaments are supplied to a braiding guide 15 which produces the braided output 16 therefrom. As each filament from a lower carrier member encounters the leading edge 17 of deflector 18, it is lifted up and over an upper carrier member as it moves along the deflector, the filament then dropping off the trailing edge of the deflector 31 so as to pass under lie next adjacent upper carrier member.

A more detailed illustration of a typical lower carrier member 10, as used in current Wardwell machines, is shown in FIG. 4. There, a bobbin 20 is mounted on a suitable spindle 21 and is retained thereon by a safety pin 22. A lower tension lever 23 having a pulley 24 mounted on its horizontal arm is spring mounted on a lower tension over retainer 25. The lever 23 is mounted by a suitable spring arrangement on the lower tension lever retainer so that its vertical arm is rotatable about its vertical axis, substantially parallel to the axis of spindle 21, as shown by arrow 26. That causes pulley 24 to move generally in a direction perpendicular to the longitudinal axis of bobbin 20. A filament of material, such as copper wire 27 from a spool on bobbin 20 is supplied, via a first thread guide roller element 28, to and around pulley 24, then to a second thread guide roller element 29, and thence upwardly (see arrow 30) to the upper carrier members 12 and braiding guide 15. As a filament on lower carrier member 10 moves relative to the upper carriers, it encounters the leading edge 17 of a deflector 18 and rides over the upper surface of the deflector so as to lift the filament up and ever an upper carrier member.

As the filament moves over deflector 18, the lower tension lever 23 is rotated under spring tension so as to move pulley 24 from an initial position inwardly toward bobbin 20. As best shown in FIG. 4, pulley 24 is in its initial position as it reaches the leading edge of a deflector and, when the filament reaches the highest region on lie surface of the deflector, the lower tension lever 23 and pulley 24 move to near their maximum spring deflected position. At this point the bobbin ratchet mechanism (at 19) is released allowing bobbin material feed to occur. When the filament drops off the trailing edge (at 31) of the deflector so as to permit the filament to drop to a lower position so as to pass under the next adjacent upper carrier, the spring action causes the lower tension lever 23 to snap back, stop the bobbin feed and return very rapidly to its initial position. Such operation produces a sufficient unwanted tension spike, or force, on the filament 30 such that breakage can occur. These tension spikes result from: the rotational acceleration and deceleration required of the lower bobbin in the feed process; the actuation of the deflector tension and bobbin ratchet mechanism; and the shape of the filament deflector surface. Such failure limits the operating speed of rotary braiding machines, the minimum size of filament that can be braided effectively, and the ability to maintain the quality of the braid produced.

The Powered Lower Bobbin Feed (PLBF) concept is proposed to eliminate or reduce the impulsive tension spikes set up by the deflection and feed process in current rotary braiding machines by uniquely controlling the lower bobbin filament feed. The preferred PLBF system includes: a slip ring 92 (see FIG. 9) designed to provide power to the lower bobbins; a variable speed powered lower bobbin concept 80 (see FIG. 9); a feedback control system 82 (see FIG. 9) for the bobbins to assure bobbin feed matches braid consumption; and an improved spline deflector surface 73 (see FIG. 8) to minimize feed tension spikes. The proposed PLBF system eliminates the need for the current bobbin ratchet drive mechanism.

Figure 5:
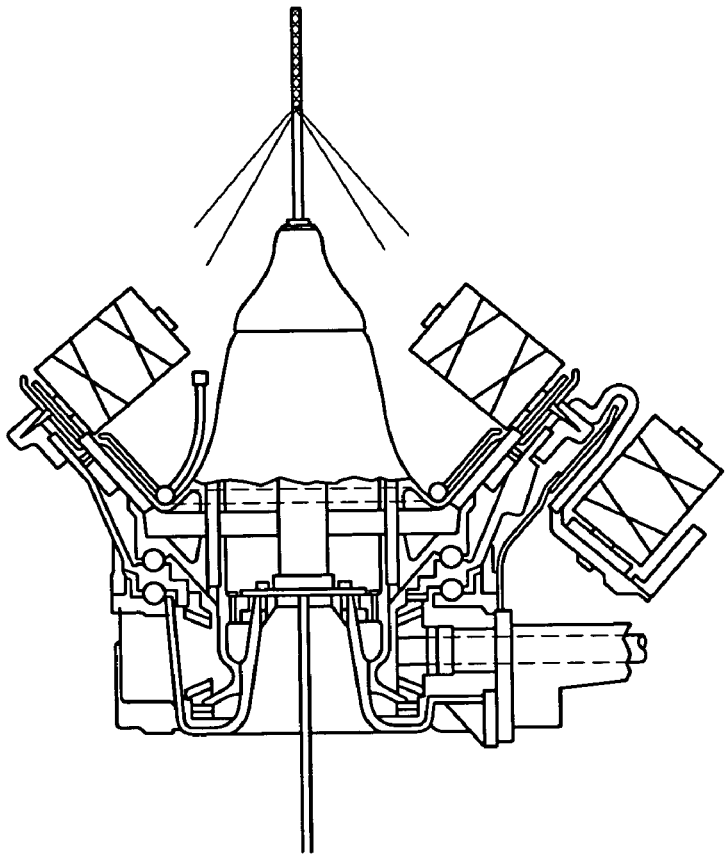
FIG. 5 (PRIOR ART)
FIG. 5, labeled "Prior Art", shows possible locations for slip rings for a preferred "Powered Lower Bobbin Feed" system, constructed in accordance with the present invention, in the Rapid Braider.

FIG. 5 presents a cross-sectional view of a representative circular braiding machine. Several slip ring locations are indicated in the figure. The slip ring design or location is not critical to the invention. Any suitable, conventional slip ring such as the Moog Components Group's large diameter slip ring, or some other available method can be used to provide continuous power to new powered lower bobbins on the rotating test bed.

In lieu of direct communication via a slip ring, a means of communicating the required bobbin payoff speed could be accomplished utilizing wireless communication. Such communication is deemed off the shelf technology. Common methods of communication could utilize methods currently employed by wireless routers. Each bobbin head could have an I.P. address and be independently controlled via a server. Another means of providing power to the bobbins could be accomplished by utilizing the existing rotation of the annular carrier. Such carrier could be designed in a way to produce power utilizing a dynamo effect. Windings could be implemented into the annular carrier in a manner in which power could be generated during the rotation about the counter rotating inner carrier. FIG. 5 also identifies the lower bobbin locations.

Figure 6:
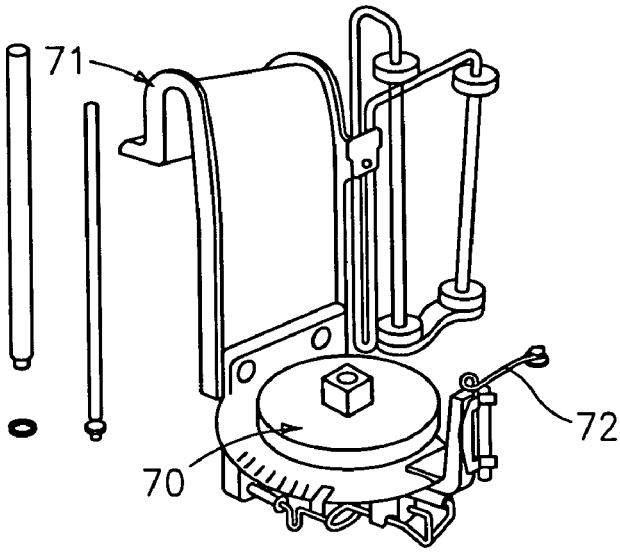
FIG. 6 (PRIOR ART)
FIG. 6, labeled "Prior Art", is a perspective view of the lower bobbin carrier member of FIG. 3.

FIG. 6 presents an isolated view of the lower bobbin carrier unit in an existing Wardwell rotary braider. FIG. 6 is reproduced from the instructional manual for the Rapid Braider, with source numbers unchanged.

Referring to FIG. 6, one way of powering the lower bobbin is to include a direct current motor in the base region 70 of each lower carrier unit. Again the location of the motors powering the lower bobbins is not critical to the invention. The lower carriages could be modified to be a continuous, annular support bracket (not shown) on which the drive motors for the bobbins could be mounted between the bobbins. The bobbin drive has to be designed to provide a controlled feed scenario for minimizing filament tension during the deflection process. One example is where the bobbin feed continuously matches the braid feed at the mandrel. Another might be where the bobbin feed is varied using a control system with feedback from the filament tension control arm shown in FIG. 6. The tension control arm 72 would be connected to a potentiometer, or some other sensing device to measure angular deflection. Control software, or hardware would vary bobbin feed with changes in tension control arm deflection to minimize filament tension during the braiding process. Such feed control is key to the invention.

Figure 7:
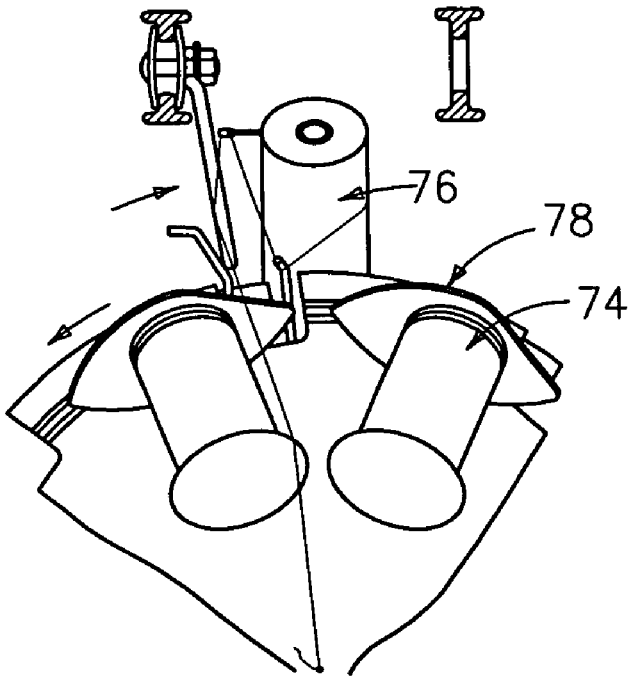
FIG. 7 (PRIOR ART)
FIG. 7, labeled "Prior Art", is a reproduction of FIG. 2 in U.S. Pat. No. 1,423,587; it is a perspective view of deflector surfaces used in the Rapid Braider.
Figure 8:
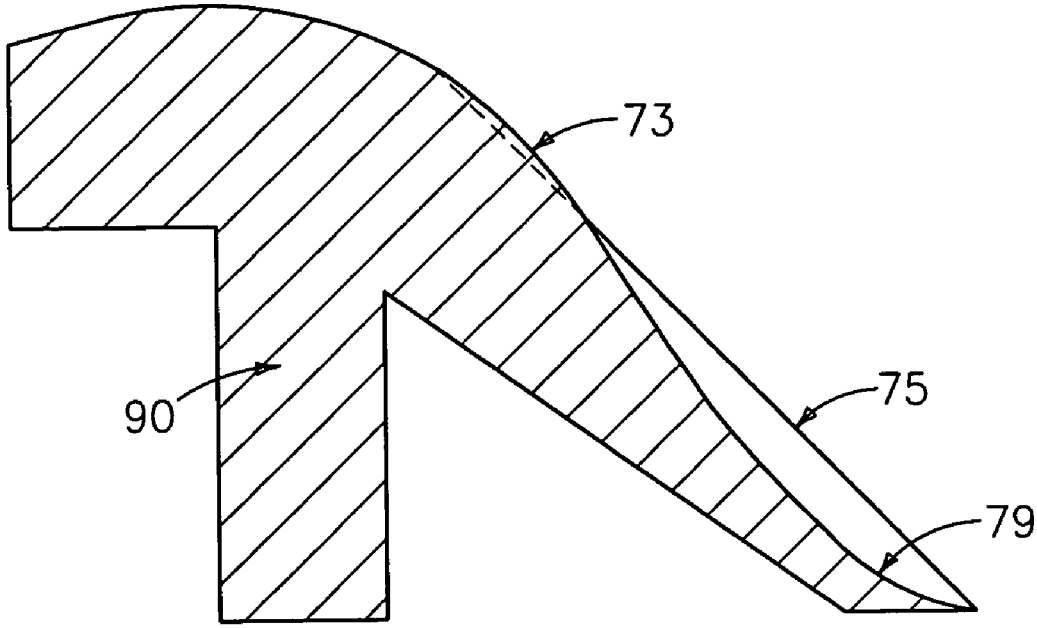
FIG. 8 shows a spline contouring change to a deflector surface of FIG. 7, in accordance with Applicants' preferred embodiment of the Powered Lower Bobbin Feed.

FIG. 7 presents a section of a representative circular braiding machine showing the upper bobbins 74 (see FIG. 7), the lower bobbins 76 (see FIG. 7) and the lower bobbin filament deflectors (e.g., 78) required for braiding. For optimum operation of such machines, the existing deflectors on such machines should be modified to assure contours with continuous first and second derivatives. One way to assure a surface with a continuous second derivative is to generate the surface using spline fits. A spline fit at 73 (see FIG. 8) numerically fits a continuous contour through points while assuring continuity in first and second derivatives. Spline surfaces (e.g., 73) will minimize filament tension spikes during the deflection process required for braiding. FIG. 8 schematically shows an improved Speed Master upper deflector surface. The original top surface 75 is shown modified with a spline surface from the filament impact area 79 to the vicinity of the maximum deflection region 73. The spline fit assures continuous acceleration of the filament during the deflection process and minimizes filament tension spikes. It becomes imperative that the deflector is machined in a manner to preserve the qualities of the spline fit.

The new contour of the deflector shown in FIG. 8 can be created: by retrofitting existing deflectors with a spline; or, by making new deflectors that incorporate the overall contour of a retrofitted deflector. The resulting shape can be though of as "contoured deflector surface means" for minimizing tension spikes.

Figure 9:
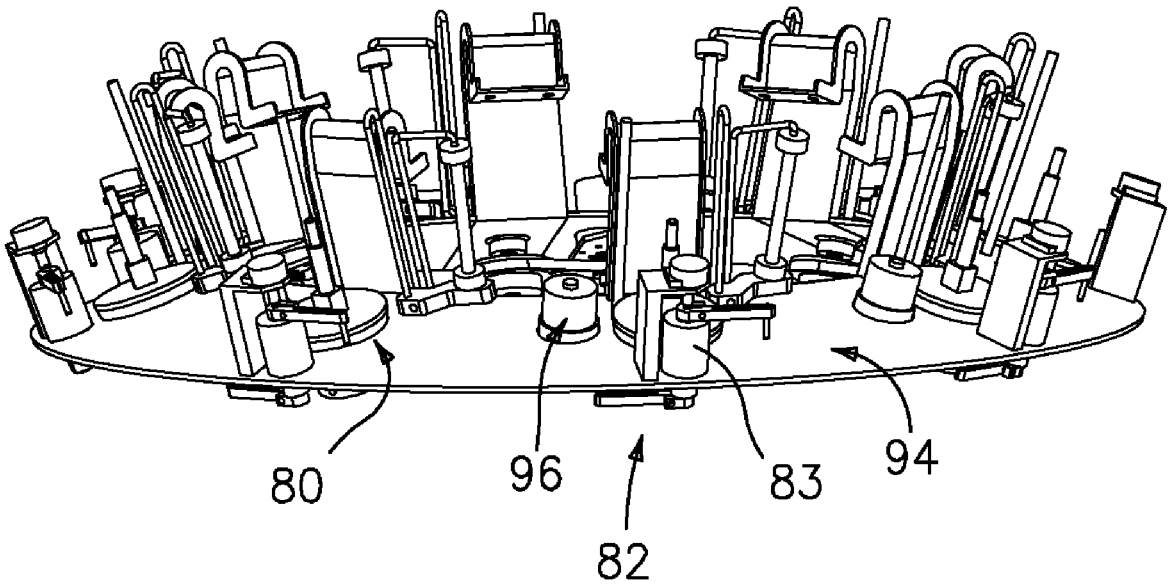
FIG. 9 shows a lower carriage modification for the Powered Lower Bobbin Feed system, including a continuous, annular support bracket on which the controls, drive motors and bobbins are mounted.

FIG. 9 presents another preferred embodiment of the PLBF system. This embodiment comprises: a slip ring 92 (see FIG. 10) designed to provide power to the lower bobbins; a variable speed powered lower bobbin concept 80; and a feedback control system 82 (described below) for the bobbins to minimize filament tension in the braiding process.

The lower carriage is modified (see FIG. 9) to be a continuous, annular support bracket 94 on which the controls, drive motors and bobbins are mounted. The continuous annular bracket 94 is equipped with slip rings 92 (see FIG. 10) or brushes (not shown) to provide continuous power to the lower bobbins. The lower bobbin ratchet feed mechanism is eliminated. A conventional direct current motor 96 is included for each bobbin drive. The location of the motors powering the lower bobbins is not critical to the invention. The motors can provide the power to the bobbins through a gear, chain or belt drive. They will be mounted on the support bracket 94 and will drive the bobbin feed during the braiding process. The bobbin drive 80 is designed to provide a controlled feed scenario for minimizing filament tension during the deflection process. The bobbin feed 80 is varied using a control system 82 with feedback from the filament tension control arm shown in FIG. 9. The tension control arm would be connected to a potentiometer 83, or some other sensing device to measure angular deflection. Control software, or hardware would vary bobbin feed with changes in tension control arm deflection to minimize filament tension during the braiding process.

Figure 10:
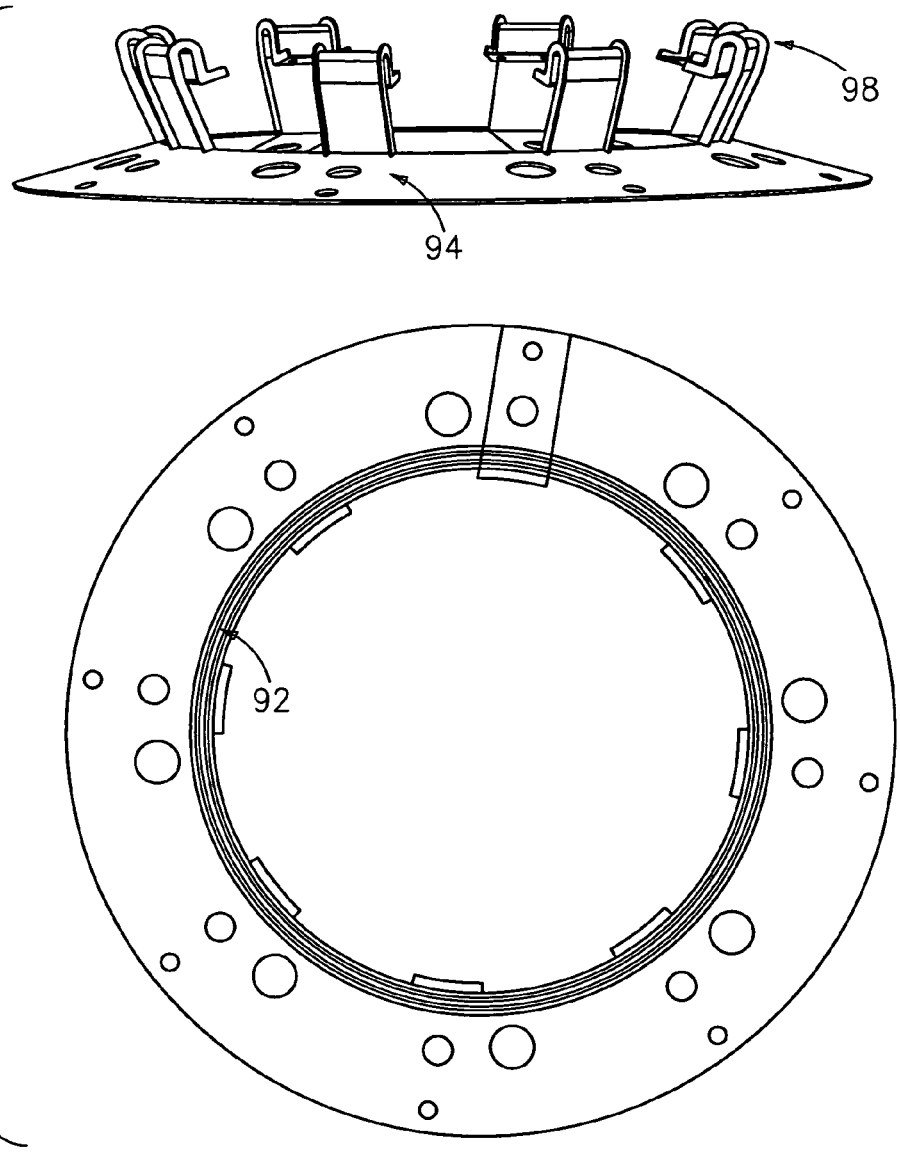
FIG. 10 shows the continuous, annular support bracket of FIG. 9 with a slip ring for powering the bobbin drive motors.

The annular support ring 94 is shown separately in FIG. 10. This support ring provides mounting access for the slip ring 92 shown underneath the annular support, powered bobbin motors (not shown), and motor controls (not shown) necessary to minimize filament tension during the braiding process. Existing bracket mounts 98 are included as part of the support ring to aid the retrofit process. The annular support bracket also increases the stiffness of the braiding machine components, and thereby reduces unwanted deflections. This results in less machine wear, a more consistent braid and less filament breakage.

Figure 11:
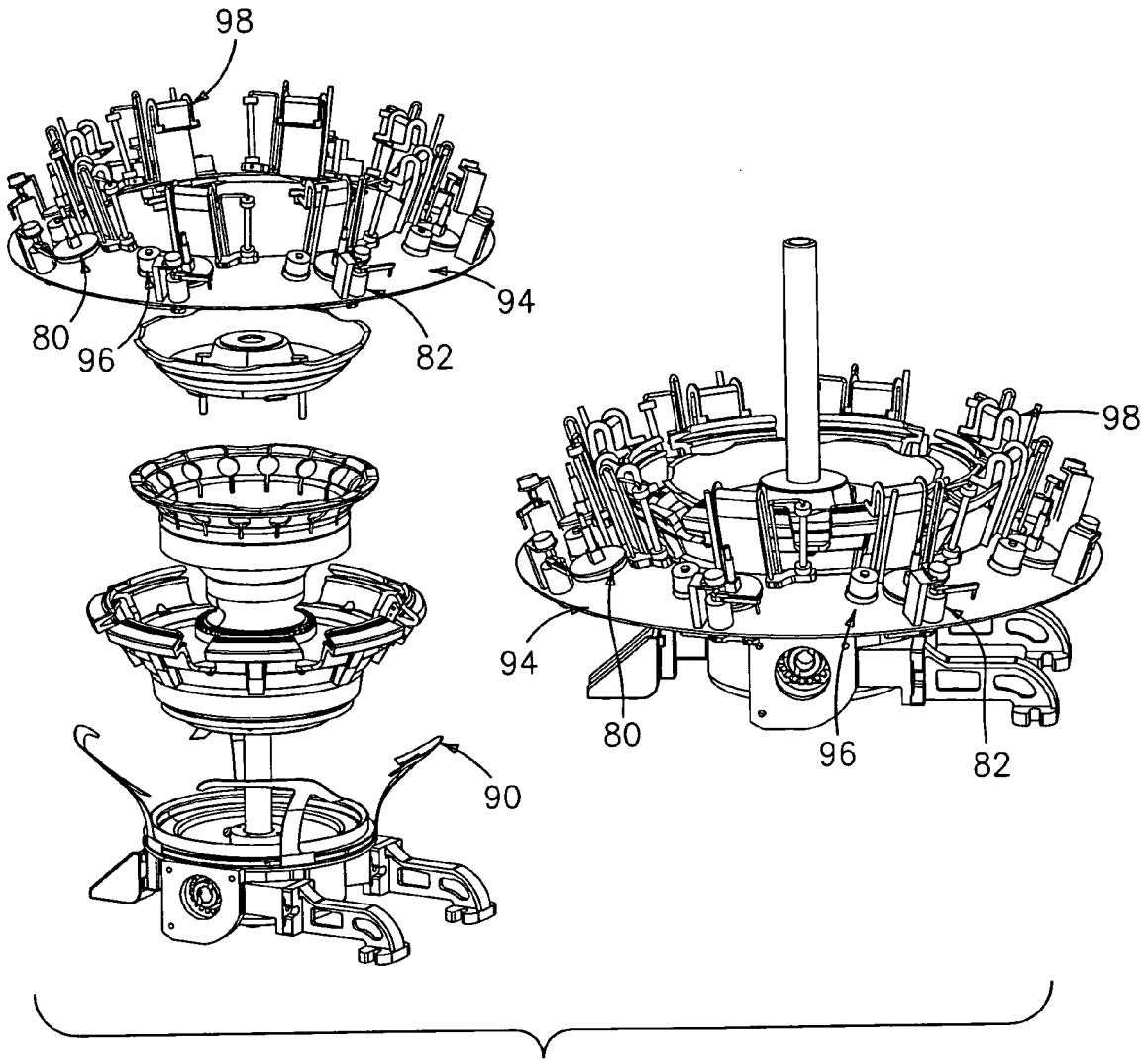
FIG. 11 shows the assembly of the preferred Powered Lower Bobbin Feed system including the continuous, annular support bracket, slip ring, controls, drive motors and bobbins on existing deflector type, circular braiding machines, like the Rapid Braider and Speed Master.

FIG. 11 presents the integration of the PLBF system with the mechanisms associated with current rotary braiding machines.

Neither the illustrated slip ring design 92 nor its location is critical to the current invention. Instead of the slip ring, another available method could be used to provide continuous power to the lower bobbins 10 on the rotating test bed. Several different wireless methods could also be used for this task. Another way of powering the lower bobbins is to include a direct current motor in the base region of each lower carrier bobbin unit. Again the location of the motors powering the lower bobbins is not critical to the invention.

The lower carriages could be modified to be a continuous, annular support bracket 94 (see FIG. 10) on which the drive motors for the bobbins could be mounted between the bobbins. The bobbin drive has to be designed to provide a controlled feed scenario for minimizing filament tension during the deflection process. One example is where the bobbin feed continuously matches the braid feed at the mandrel. Another might be where the bobbin feed is varied using a control system with feedback from the filament tension control arm. The tension control arm would be connected to a potentiometer, or some other sensing device to measure angular deflection. Control software, or hardware would vary bobbin feed with changes in tension control arm deflection to minimize filament tension during the braiding process.

It should be understood by those skilled in the art that obvious structural modifications can be made to the PLBP, beyond those noted above, without departing from the spirit of the invention. Accordingly, reference should be made primarily to the accompanying claims rather than the foregoing description to determine the scope of the invention.

We claim:

1. In a rotary braiding machine of the type having upper and lower arrays of bobbins which rotate in opposite directions about a common center axis to wind a fed filament around a mandrel at the center axis, with filament deflectors and guides associated with each lower bobbin directing the filament alternately below and above the upper bobbins as the bobbin arrays rotate, to produce a braid, the improvement comprising a contoured deflector surface means to minimize feed tension spikes during operation of the machine, wherein the contoured deflector surface means comprises each filament deflector having a deflection surface contoured with continuous first and second derivatives.

2. The braiding machine of claim 1 wherein the contoured deflector surface means comprises a spline on each filament deflector.

3. In a rotary braiding machine of the type having upper and lower arrays of bobbins which rotate in opposite directions about a common center axis to wind a fed filament around a mandrel at the center axis, with filament deflectors and guides associated with each lower bobbin directing the filament alternately below and above the upper bobbins as the bobbin arrays rotate, to produce a braid, the improvement comprising:

a. variable speed direct current motor means for providing power to the lower array of bobbins as the braiding machine rotates; and b. feedback control means to automatically vary the motor speed to reduce the filament tension spikes generated by such deflector machines during the braiding process, wherein the control means includes a spline deflector surface to minimize feed tension spikes during operation of the machine, whereby:

(i) the braiding machine can operate faster without filament breakage than current rotary braiding machines and provide a more consistent quality in the braid generated by current rotary braiding machines.

4. In a rotary braiding machine of the type having upper and lower arrays of bobbins which rotate in opposite directions about a common center axis to wind a fed filament around a mandrel at the center axis, with filament deflectors and guides associated with each lower bobbin directing the filament alternately below and above the upper bobbins as the bobbin arrays rotate, to produce a braid, the improvement comprising:

a. variable speed direct current motor means for providing power to the lower array of bobbins as the braiding machine rotates; and b. feedback control means to automatically vary the motor speed to reduce the filament tension spikes generated by such deflector machines during the braiding process, whereby the braiding machine can operate faster without filament breakage than current rotary braiding machines and provide a more consistent quality in the braid generated by current rotary braiding machines.

5. The braiding machine of claim 4 wherein the improvement further comprises a contoured deflector surface means to help minimize feed tension spikes during operation of the machine.

6. The braiding machine of claim 5 wherein the contoured deflector surface means comprises a spline on each filament deflector.

7. In a rotary braiding machine of the type having upper and lower arrays of bobbins which rotate in opposite directions about a common center axis to wind a fed filament around a mandrel at the center axis, with filament deflectors and guides associated with each lower bobbin directing the filament alternately below and above the upper bobbins as the bobbin arrays rotate, to produce a braid, the improvement comprising:

a. variable speed direct current motor means for providing power to the lower array of bobbins as the braiding machine rotates, wherein the drive means includes slip rings and associated drive motors to provide power from respective bobbin drive motors to rotate the lower bobbins;

b. feedback control means, attached to the bobbins, for assuring minimum filament tension during braiding by the machine; and c. contoured deflector surface means to minimize feed tension spikes.

8. The powered lower bobbin feed of claim 7 further comprising a continuous, annular support bracket on which the following items are mounted:

a. the lower array of bobbins;

b. the drive motors;

c. the slip rings, and d. a control feed means for minimizing filament tension during braiding, wherein the control feed means utilizes feedback from a tension control arm in the rotary braiding machine to automatically vary feed of any filament to the lower bobbins.

9. The improvement of claim 8 further comprising an annular support bracket on which the motor controls, drive motors and bobbins are mounted, wherein the annular bracket is equipped with the slip rings to provide continuous electrical power to rotate the lower array of bobbins to rotate bobbins.

10. The improvement of claim 8 further comprising a potentiometer connected to the tension control arm to measure angular deflection of the tension control arm; and, control software, which is connected to the potentiometer, varies bobbin feed with changes in tension control arm deflection to minimize filament tension during the braiding process.

* * * * *